US006901614B2

(12) United States Patent
Holub et al.

(10) Patent No.: US 6,901,614 B2
(45) Date of Patent: Jun. 7, 2005

(54) SLEEPING BAG WITH CLASP FOR FACILITATING ROLLING

(75) Inventors: Timothy M. Holub, Cheney, KS (US); Susan Michaelis, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/449,154

(22) Filed: May 30, 2003

(65) Prior Publication Data

US 2004/0237192 A1 Dec. 2, 2004

(51) Int. Cl.[7] ..... A47G 9/08
(52) U.S. Cl. ..... 5/413 R; 5/502; 5/5; 5/486
(58) Field of Search ..... 5/413 R, 417, 5/420, 494, 502; 2/69.5; 383/4; 190/2

(56) References Cited

U.S. PATENT DOCUMENTS

| | | | | |
|---|---|---|---|---|
| 730,877 A | * | 6/1903 | Clapham | 224/156 |
| 872,404 A | | 12/1907 | Burch | |
| 917,403 A | | 4/1909 | Benger | |
| 1,253,039 A | * | 1/1918 | Hunt et al. | 5/413 R |
| 1,281,692 A | * | 10/1918 | Stonebridge | 2/69.5 |
| 1,653,815 A | | 12/1927 | Millar | |
| 1,915,044 A | | 6/1933 | Anderson | |
| 2,229,935 A | | 1/1941 | Powers | |
| 2,368,220 A | | 1/1945 | Hinds | |
| 2,720,654 A | | 10/1955 | Stephenson | |
| 2,913,043 A | | 11/1959 | Achner | |
| 2,972,757 A | * | 2/1961 | Adrian | 2/69.5 |
| 3,477,552 A | | 11/1969 | Goldman | |
| 3,597,764 A | | 8/1971 | Povey | |
| 3,750,202 A | | 8/1973 | Merikallio | |
| 4,128,908 A | | 12/1978 | Kerbs | |
| 4,223,056 A | | 9/1980 | DiFronzo | |
| 4,292,700 A | * | 10/1981 | Markel | 5/413 R |
| 4,513,461 A | * | 4/1985 | Tardivel | 5/413 R |
| 4,574,397 A | | 3/1986 | Dennard | |
| 4,575,876 A | | 3/1986 | Weaver | |
| 4,587,682 A | * | 5/1986 | Schultz | 5/413 R |
| 5,210,911 A | | 5/1993 | Brown et al. | |
| 5,265,292 A | | 11/1993 | Underell | |
| 5,303,874 A | | 4/1994 | Le Masters | |
| D346,923 S | | 5/1994 | Holm | |
| 5,404,600 A | * | 4/1995 | DeMars | 5/413 R |

(Continued)

FOREIGN PATENT DOCUMENTS

| | | |
|---|---|---|
| DE | 29601617 U1 | 3/1996 |
| FR | 2396490 | 1/1979 |
| GB | 6465 | 12/1915 |
| GB | 115369 | 5/1918 |

OTHER PUBLICATIONS

Copy of Invitation to Pay Additional Fees with partial international search (Annex) by the EPO (Nov. 4, 2004).

*Primary Examiner*—Michael Trettel
(74) *Attorney, Agent, or Firm*—Leydig, Voit & Mayer, Ltd.

(57) ABSTRACT

A sleeping bag that includes at least one clasp configured and arranged to hold sections of a sleeping bag together while the sleeping bag is rolled for storage. In use, when a user desires to roll the sleeping bag, sections of the sleeping bag are folded together, and the clasp or clasps are utilized to hold the sections of the sleeping bag together, which may help in maintaining alignment of the sections during rolling. In accordance with another embodiment, an inner liner extends along the inside of the sleeping bag and is exposed to part of the outer surface of the sleeping bag. The portion of the inner liner extending beyond the outer cover extends back over a section of the outer cover to form a cushion at the head of the sleeping bag.

6 Claims, 2 Drawing Sheets

U.S. PATENT DOCUMENTS

| | | | | | |
|---|---|---|---|---|---|
| D365,485 | S | | 12/1995 | Rossman | |
| 5,509,141 | A | | 4/1996 | Saltzman | |
| D377,879 | S | | 2/1997 | Walden | |
| 5,887,299 | A | * | 3/1999 | Phillips | 5/413 R |
| 5,887,301 | A | | 3/1999 | Anderson | |
| D420,780 | S | | 2/2000 | Cox et al. | |
| D428,049 | S | | 7/2000 | Imai | |
| 6,199,232 | B1 | * | 3/2001 | Kocivar | 5/502 |
| 6,311,330 | B1 | | 11/2001 | Rothman | |
| 6,367,083 | B1 | | 4/2002 | November | |
| 6,438,774 | B1 | | 8/2002 | Michaelis et al. | |
| 6,557,192 | B2 | | 5/2003 | Zheng | |
| 476,516 | A1 | | 7/2003 | Pigg | |
| 2002/0078501 | A1 | | 6/2002 | Lamke | |
| 2002/0083526 | A1 | | 7/2002 | Zheng | |
| 2002/0104162 | A1 | | 8/2002 | Stewart | |

* cited by examiner

SLEEPING BAG WITH CLASP FOR FACILITATING ROLLING

TECHNICAL FIELD OF THE INVENTION

The present invention is directed to sleeping bags, and more particularly to a sleeping bag that is rolled into a tight formation for storage and transportation.

BACKGROUND OF THE INVENTION

In general, a sleeping bag is a bag that is warmly lined or padded for sleeping outdoors, for example in a camper or a tent. Sleeping bags may also be used for sleeping on the floor inside a house, such as on a sleepover, or may be used as convenient bedding material when traveling.

Sleeping bags typically include a bottom portion, upon which an individual within the sleeping bag lays, and a top portion which extends over to cover the individual. Often, the top and bottom portions are made of a single, large rectangular insulated or padded fabric that is folded and attached along bottom and side edges to form the bag. The attachment is typically made by a zipper.

Sleeping bags are often folded and rolled into a tight ball for storage. After rolled, most rolled rectangular sleeping bags, are tied with tie cords, compression straps, or elastic straps, or may be otherwise secured so that the sleeping bag does not become unrolled during storage.

One problem associated with rolling of sleeping bags is that once the sleeping bag is folded (for example, lengthwise), it is often difficult to roll the sleeping bag without the edges of the sleeping bag being forced apart during the rolling process. For this reason, many users find it difficult to roll the sleeping bags into a tight, tidy configuration so that closure may be secured for transportation and storage.

Sleeping bags typically have a rough outer cover and a much softer, for example flannel, liner. The cover is made of more durable, rough material, so that it may resist wear, for example when the sleeping bag is laying on the ground or within a tent. The liner is typically made of a softer material, because the liner contacts the body of the user. One problem with such designs is that a user's head and arms often extend out of the sleeping bag and may come into contact with the coarse cover, which may be uncomfortable.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with one embodiment, a sleeping bag is provided that includes at least one clasp configured and arranged to hold sections of a sleeping bag together while the sleeping bag is rolled for storage. The clasp may be, for example, loop and hook fasteners, a loop and toggle fastener, a clip, ties, or other suitable connectors. In use, when a user desires to roll the sleeping bag, sections of the sleeping bag are folded together, and the clasp or clasps are utilized to hold the sections of the sleeping bag together, which may help in maintaining alignment of the sections during rolling.

In accordance with another embodiment, a sleeping bag is provided having an outer cover and an inner liner. The inner liner extends along the inside of the sleeping bag and is exposed to part of the outer surface of the sleeping bag. As one example, the inner liner extends beyond the outer cover. The portion of the inner liner extending beyond the outer cover extends back over a section of the outer cover to form a cushion at the head of the sleeping bag. This configuration provides a comfortable, soft cushion for the user's head, arms, and/or body extending out of the sleeping bag.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
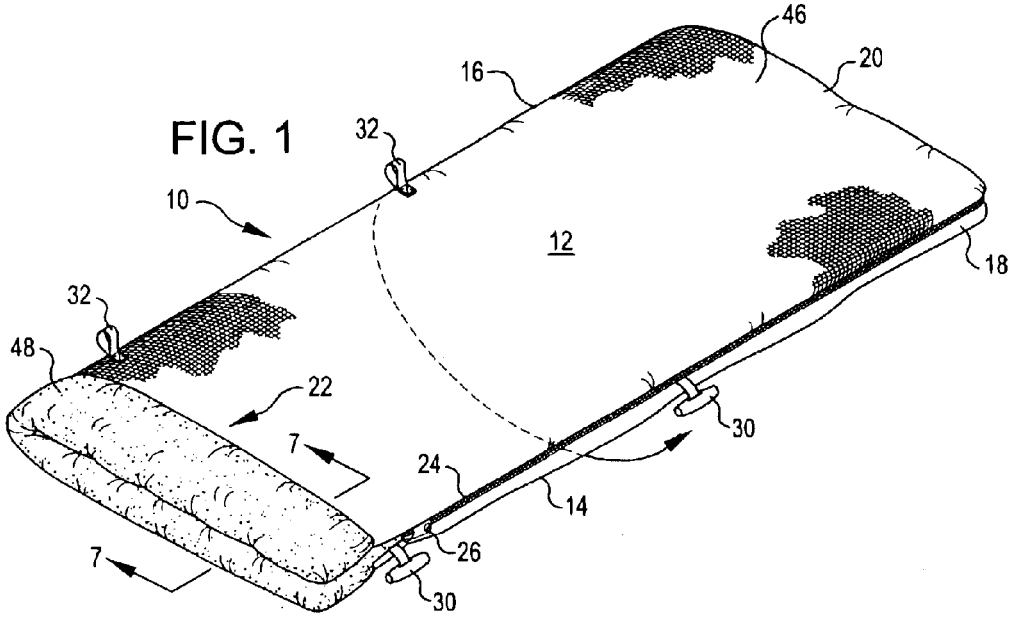
FIG. 1 shows a perspective view one embodiment of a sleeping bag.

Referring now to the drawings, in which like reference numerals represent like parts throughout the several views, FIG. 1 shows a sleeping bag 10 in accordance with one embodiment. The sleeping bag 10 includes a top 12 and a bottom 14. Left and right edges 16, 18 extend along sides of the sleeping bag 10. The sleeping bag 10 includes a foot 20 and a head 22. A zipper 24 extends along the foot 20 and the right edge 18 of the sleeping bag 10, and includes a zipper pull 26.

The sleeping bag 10 is of a standard configuration, and in the embodiment shown is generally a rectangular bag formed by the top 12 being folded over the bottom 14, and connection of the top 12 and bottom 14 by the zipper 24. Although the configuration of the sleeping bag 10 in the drawings utilizes a fold-over construction and connection by a zipper, many other configurations may be utilized. For example, a bag may be formed in which a connection is made at the top or bottom of the sleeping bag, instead of along the side edges. In addition, the bag may be folded and sewn or otherwise permanently connected. The top 12 and the bottom 14 may be formed of two different pieces, and may be connected along their edges to form a sleeping bag. Furthermore, although shown as a rectangle, the sleeping bag may have any shape, including a mummy shape, a more square, or "double" shape, or other configurations.

Figure 4:
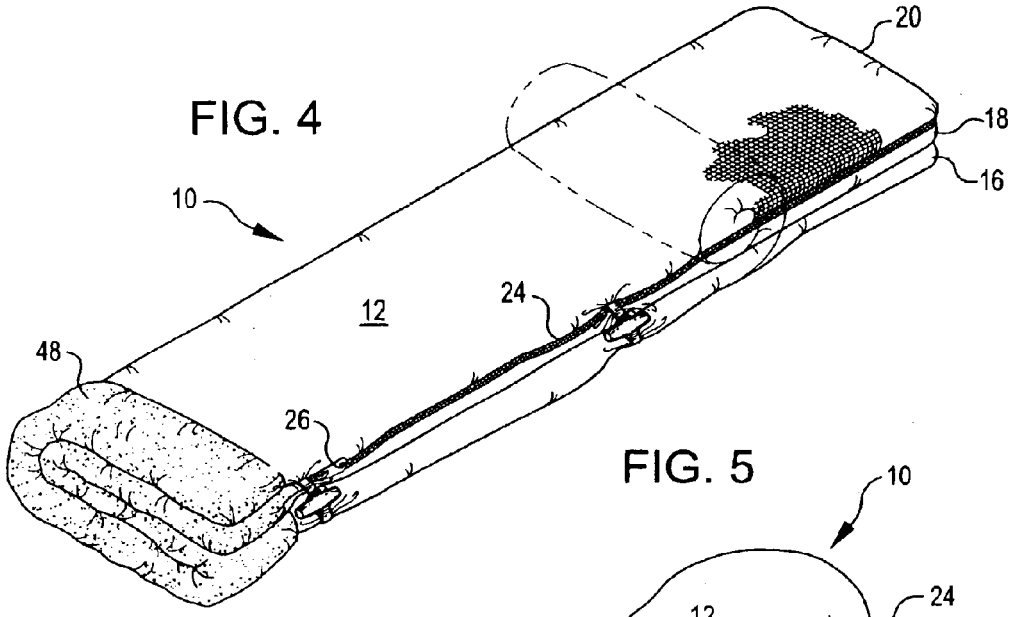
FIG. 4 shows the sleeping bag of FIG. 1 in a folded and partially rolled position.

In accordance with one embodiment, the sleeping bag 10 is folded such as is shown in FIG. 4 and then is rolled for storage (partial rolling is shown in FIG. 4 for the benefit of the reader). Although the embodiment shown in the drawings includes a sleeping bag 10 that is folded lengthwise, other embodiments may be folded in other ways, as non-limiting examples, in thirds or fourths, folded along a diagonal, or folded both along a width and a length.

In general, the edges of a sleeping bag are apt to move laterally when the sleeping bag is folded and then rolled in a direction anything other than perpendicular with the fold line. To this end, as used herein, rolling "along a fold line" means rolling in a direction other than perpendicular to the fold line.

In accordance with one embodiment, one or more clasps are provided for holding sections or layers of the sleeping bag 10 together after the sleeping bag has been folded. In general, as used herein, the "clasp" or "clasps" are devices for holding the folded sections of the sleeping bag together. To this end, the clasp or clasps may aid in maintaining alignment of the folded sections during rolling of the sleeping bag along a fold line (i.e., the line formed at the fold of two sections or layers). That is, the clasps limit lateral separation of the side edges of the folded sleeping bag during rolling. In this manner, a desired even width roll of the sleeping bag is facilitated, without a user being required to realign the folded layers of the sleeping bag during rolling along a fold line.

Figure 2:
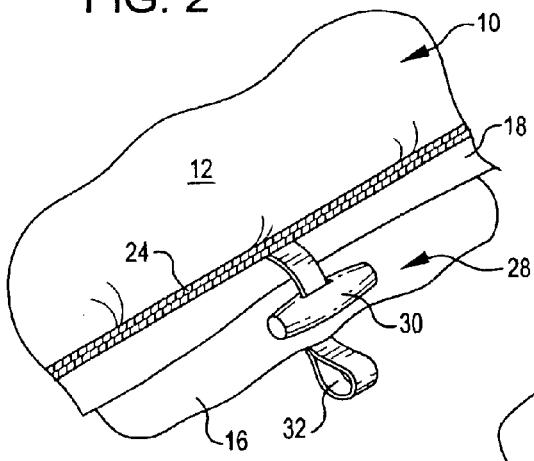
FIG. 2 shows a detail view of an embodiment of a clasp that may be used with the sleeping bag of FIG. 1.
Figure 3:
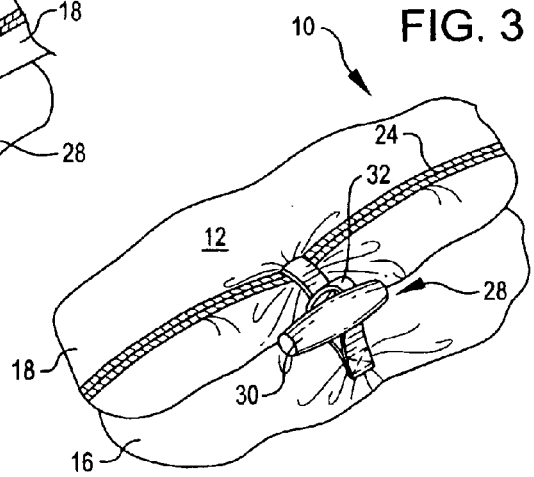
FIG. 3 shows the clasp of FIG. 2 in a closed position.

One embodiment of a clasp 28 is shown in FIGS. 1, 2 and 3. In the embodiment shown, two clasps 28 are used on the sleeping bag, but any number, including one, may be used. The clasps 28 each include a toggle 30 and a loop 32, as can best be seen in FIGS. 2 and 3. When the sleeping bag 10 is folded lengthwise, the toggles 30 are placed within the loops 32, locking the upper layer of the folded portion of the sleeping bag 10 against the lower layer of the folded portion of the sleeping bag 10. In this manner, the sleeping bag 10 may be rolled along its fold line, as is shown in phantom in FIG. 4, with only limited movement of the upper layer of the folded portion relative to the lower layer of the folded portion. The fold line in the embodiment shown in FIG. 4 extends parallel to the side edges 16, 18, and rolling of the bag is parallel to the fold line.

In the embodiment shown in the drawings, the clasps 28 are located at approximately a mid-portion and a head portion of the sleeping bag 10. However, depending upon which way the sleeping bag 10 is to be rolled, the clasps 28 may be located alternatively at a foot portion, or at any position or positions along the length or width of the sleeping bag 10. In addition, a single clasp 28 may be used. Also, if desired, more than two clasps 28 may be used along the length of the sleeping bag 10.

In the embodiment shown, the loops 32 are position at the left edge 16 of the sleeping bag, and the toggles are positioned at the right edge 18, adjacent the zipper. Positioning the toggles adjacent to the zipper permits the toggles to be attached to zipper tape for the zipper, which may provide strong structural support for attachment of the toggle. The clasps may, however, be positioned or attached in multiple different locations depending upon the intended folding of the sleeping bag. In an alternate embodiment, the clasps may be attached to or may be a part of the zipper 24, for example by one of the toggles 30 being attached to the zipper pull 26.

Figure 5:
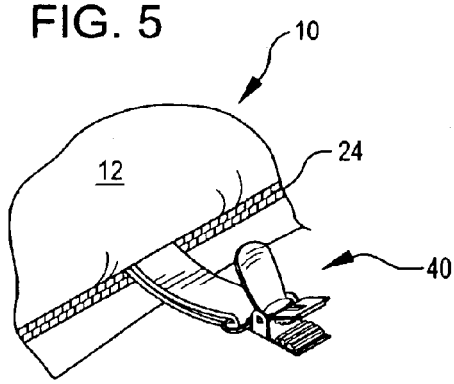
FIG. 5 shows an alternate embodiment of a clasp that may be used with the sleeping bag of FIG. 1.
Figure 6:
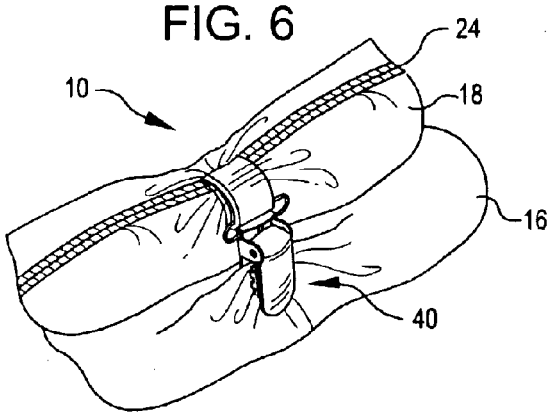
FIG. 6 shows the clasp of FIG. 5 attached to an a section of the sleeping bag.

An example of another attachment mechanism that may be used as the clasp is shown in FIGS. 5 and 6. In this embodiment, the clasp is a clip 40 that is attached to a side edge of the sleeping bag 10, and may be used to attach to part of the fabric or some other structure on the folded over section of the sleeping bag 10 (FIG. 6).

Other clasps may be used. For example, ties, Velcro™ hook and loop fasteners, buttons, snaps, clips, clamps, or other devices that hold sections of a sleeping bag together while the sleeping bag is folded may be utilized. In addition, while the shown embodiments are attached to the sleeping bag, an alternate embodiment may include clasps that are not attached to the sleeping bag, and which are attached upon folding and rolling of the sleeping bag.

Figure 7:
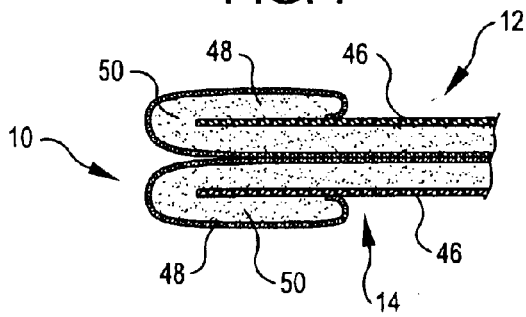
FIG. 7 is a sectional view taken along the section lines 7—7 of FIG. 1.

As can best be seen in FIG. 7, in accordance with one embodiment, the sleeping bag 10 includes an outer cover 46 that extends along the top 12 and the bottom 14. In addition, the sleeping bag 10 includes an inner liner 48 that extends along the inside surfaces of the sleeping bag 10. In accordance with one embodiment, the inner liner 48 extends outside the outer cover 46 at the head 22 of the sleeping bag 10. The inner liner 48 in the embodiment shown in FIG. 7 extends beyond the end of the outer cover 46 and wraps back toward the foot 20 for a length of the sleeping bag 10, for example, for a length of one to six inches, or more preferably, four inches. Other lengths or widths of the liner material may be used. The liner material in the embodiment shown extends around the perimeter of the head 22 of the sleeping bag 10, but may alternatively extend around only a portion of the head, such as only the top 12 of the sleeping bag 10.

By extending the inner liner 48 around the outer cover 46, the outer cover 46, which is typically made of a more durable, sturdy material, can provide support for the inner liner 48 that extends outside of the sleeping bag 10. However, in an alternate embodiment, the inner liner 48 may simply extend beyond the end of the outer cover 46 so that the inner liner 48 is exposed at the end of the sleeping bag 10.

The material of the inner liner 48 may be a softer material, such as flannel, or another soft fabric. In one embodiment, the inner liner 48 that extends outside the sleeping bag 10 includes fill material 50 filled with a fill material, and, by extending beyond or over the head end of the outer cover 46, provides comfort to extremities of the user that extend out of the head end of the sleeping bag 10.

Other embodiments are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A sleeping bag, comprising:

a bag having a head portion;

an outer cover extending over the outside of the bag; and an inner liner lining the inside of the bag and comprising an extended portion comprising a filling and extending out of the head portion of the bag.

2. The sleeping bag of claim 1, wherein the extended portion is attached to an outer portion of the outer cover.

3. The sleeping bag of claim 1, wherein the extended portion extends over the outer portion more than approximately 1 inch.

4. The sleeping bag of claim 1, wherein the extended portion extends over the outer portion between approximately 1 inch and six inches.

5. The sleeping bag of claim 1, wherein the extended portion extends over the outer portion approximately 4 inches.

6. The sleeping bag of claim 1, wherein the extended portion extends around a perimeter of the head portion.

* * * * *